United States Patent [19]

Marcus

[11] 3,956,031

[45] May 11, 1976

[54] MAGNETIC MATERIALS AND THE FORMATION THEREOF

[75] Inventor: Harris L. Marcus, Thousand Oaks, Calif.

[73] Assignee: Texas Instruments Incorporated, Dallas, Tex.

[22] Filed: Dec. 24, 1969

[21] Appl. No.: 887,833

[52] U.S. Cl. ..... 148/103; 148/31.57; 148/105

[51] Int. Cl.[2] ..... H01F 1/02

[58] Field of Search ..... 148/100, 101, 102, 103, 148/104, 105, 108, 31.57; 164/83, 84, 256, 258, 276; 117/106, 107.1, 107.2, 235, 238, 240

[56] References Cited

UNITED STATES PATENTS

| | | | |
|---|---|---|---|
| 2,706,329 | 4/1955 | Hespenheide | 148/100 X |
| 2,853,402 | 9/1958 | Blois, Jr. | 117/71 |
| 3,181,209 | 5/1965 | Smith, Jr. | 164/64 X |
| 3,183,563 | 5/1965 | Smith, Jr. | 164/258 X |
| 3,374,113 | 3/1968 | Chang et al. | 148/103 X |
| 3,398,780 | 8/1968 | Yearley | 164/83 X |
| 3,424,578 | 1/1969 | Strnat et al. | 75/213 |
| 3,546,030 | 12/1970 | Buschow et al. | 148/31.57 |
| 3,576,670 | 4/1971 | Hammond | 117/107.1 |
| 3,615,275 | 10/1971 | Turk et al. | 117/107.1 |
| 3,615,911 | 10/1971 | Nesbitt et al. | 148/31.57 |

OTHER PUBLICATIONS

Rhodin, T. N. et al.; *Nucleation & Growth Process on Solid Surfaces, in Metal Surfaces*, ASM, 1963, pp. 270–281.

Hoffer, G. et al.; *Magnetocrystalline Anisotropy of* $YCo_5$ & $Y_2Co_{17}$, in IEEE Trans. Magn., Sept. 1966, pp. 487–489, (TR7870I23).

*Primary Examiner*—Walter R. Satterfield
*Attorney, Agent, or Firm*—John A. Haug; James P. McAndrews; Russ Baumann

[57] ABSTRACT

A method of producing a magnetic material having a high magnetic anisotropy constant. A vapor phase of the components of the material is established and the vaporized components are passed into contact with a substrate maintained at a temperature such that the material will solidify and deposit thereon in the form of crystals with basal planes parallel to the plane of the substrate. The vapor deposited material is separated from the substrate and subjected to a magnetic field thereby to orient the crystals whereby a permanent magnet material is produced. Apparatus for producing the material includes means for vaporizing the components of the material. A substrate in the form of an endless belt is positioned relative to the vaporizing means so as to be exposed to the vapors and moves around rollers. Means are provided for controlling the temperature of the substrate within a preselected temperature range in a first zone so that the material solidifies as a deposit on the substrate. Means are provided for vibrating the belt in a second zone spaced from the first zone whereby separating the vapor deposited material from the substrate. Collection means are positioned below the vibrating zone of the substrate for collecting the separated vapor deposited material. The resulting permanent magnet material has a high magnetic anisotropy and comprises oriented crystals of an alloy of cobalt and a rare earth with parallel basal planes and a close packed hexagonal grain structure.

4 Claims, 1 Drawing Figure

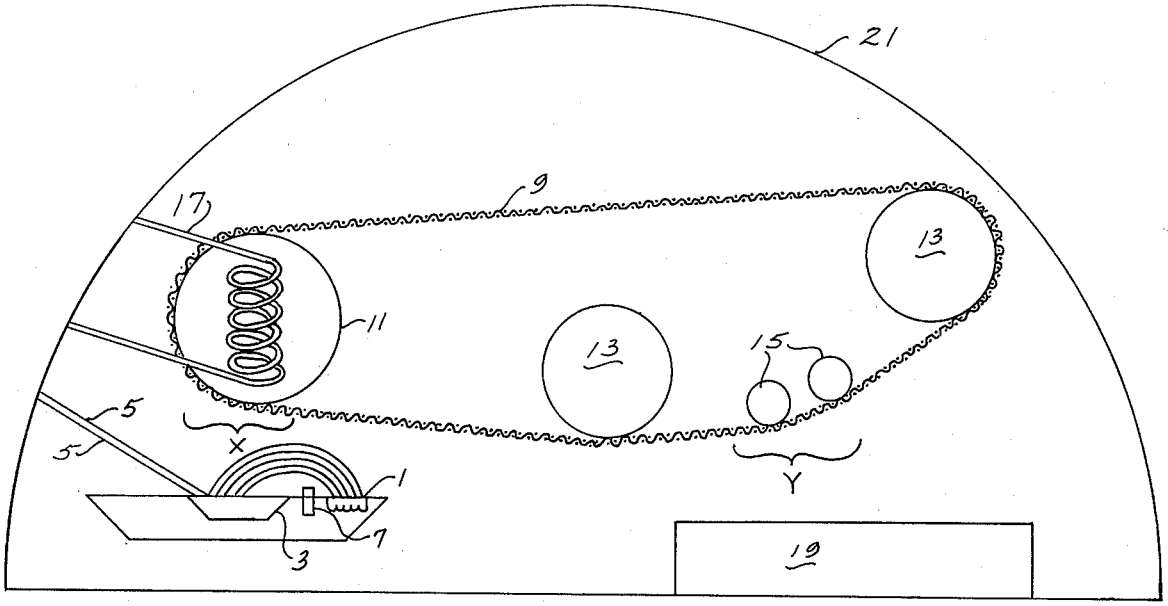
Harris L. Marcus
Inventor.

MAGNETIC MATERIALS AND THE FORMATION THEREOF

The instant invention relates to magnetic materials and apparatus for and a method of producing a magnetic material having a high anisotropy constant. A number of permanent magnet alloys are in general use, such as that known as Alnico V, an alloy containing 8% aluminum, 14% nickel, 24% cobalt, 3% copper, balance iron. In 1958 a newer permanent magnetic material, oriented barium ferrite, a ceramic magnet, was introduced. These ceramic magnets also have a desirable energy product (product of coercive force and remanence). This ceramic magnetic material is lighter in weight than the Alnico V and enjoyed almost immediate acceptance. However, there has remained an unfilled need for a material requiring a very high coercive force, i.e., one which requires the application of a strong magnetic field to demagnetize the material. Thus, as useful as barium ferrite has proven to be, there has remained a need for a harder magnetic material, i.e., one with a very high coercive force.

It is an object of the instant invention to produce a material exhibiting a very high magnetic anisotropy. Desirably, the material produced has a texture and form extremely useful for permanent magnets. It is an object of the instant invention to control the process of producing these materials so that either a foil or a powder may be produced which can then be subjected to a high magnetic field, producing a hard permanent magnet, i.e., one with high coercive force.

It is a further object of the instant invention to produce a material that can be magnetically saturated through the application of a magnetic field of much less magnitude than heretofore possible. The permanent magnet produced desirably is a much harder magnet, and the coercive force or magnetic field necessary to demagnetize it is much greater than for conventional permanent magnet materials. Other objects and features will be in part apparent and in part pointed out hereinafter.

Briefly one aspect of the present invention is a method of producing a magnetic material having a high magnetic anisotropy constant. A vapor phase of the components of the material is established and the vaporized components are passed into contact with a substrate maintained at a temperature such that the material will solidify and deposit thereon in the form of crystals with basal planes parallel to the plane of the substrate. The vapor deposited material is separated from the substrate and subjected to a magnetic field thereby to orient the crystals whereby a permanent magnet material is produced.

Another aspect of this invention includes apparatus for producing an easily magnetizable material by vapor deposition. Means are provided for vaporizing the components of the material. A substrate in the form of an endless belt is positioned relative to the means so as to be exposed to the vaporized components and moves around rollers. Means are provided for controlling the temperature of the substrate to within a preselected temperature range in a first zone so that the material solidifies as a deposit on the substrate. Means for vibrating the belt are provided in a second zone spaced from the first zone thereby separating the vapor deposited material from the substrate. Collection means are positioned below the vibrating zone of the substrate for collecting the separated vapor deposited material.

The preferred material is a permanent magnet material having a high magnetic anisotropy comprising oriented crystals of cobalt and a rare earth and having parallel basal planes and a close packed hexagonal grain structure.

The drawing shows a schematic representation of one of various possible embodiments of vapor deposition apparatus of this invention for carrying out a method for forming the magnet materials in accordance with this invention.

Permanent magnet materials get their permanency from either geometric or crystalline anisotropy considerations. Materials such as those ferrites widely used in magnetic tape and Alnico V get their permanency from the shape of the particles, i.e., from geometric anisotropy. Barium ferrite gets its permanency from crystalline anisotropy. It has been found that alloys of cobalt and a rare earth (used herein to include the elements scandium and yttrium as well as the group of elements that have atomic numbers 57 to 71) or a combination of rare earths, particularly an alloy constituted by the intermetallic compound $RCo_5$ wherein R is a rare earth such as cerium, praseodymium, samarium and yttrium, or a combination of such rare earths, is useful in making permanent magnet materials. These materials get their permanency from the high value of crystalline magnetic anisotropy of the $RCo_5$ intermetallic compounds. The easy direction of magnetization of these materials is the <00.1> direction. Their high anisotropy constant makes $RCo_5$ materials having crystals with parallel basal planes quite useful as permanent magnet materials. These materials, when the crystals are properly oriented, develop a much higher magnetic intensity for a given applied field than when the material is geometrically oriented. For example, a field which would produce a magnetic intensity in a $RCo_5$ material of about 10,000 oersteds when applied in the direction of geometric anisotropy will produce 100,000 oersteds applied in the direction of crystalline anisotropy.

The close packed plane in the hexagonal crystal structure is the <00.1> plane. If the $RCo_5$ alloys are vapor deposited on a substrate maintained within a certain temperature range, a highly textured foil is produced. When this foil is subjected to a strong magnetic field, a permanent magnet foil results. This foil is useful as a permanent magnet foil to bias devices or can be used in stacked form as high field strength bulk permanent magnets.

A flaky powder deposit with the same type of texture may be made by depositing the material on a substrate maintained within a lower temperature range. Such flakes may then be oriented in a field and compacted with a binder to form high field strength bulk permanent magnet material.

Although the instant invention is described with specific reference to $RCo_5$ alloys, it is to be understood that the invention is not limited thereto but is applicable to any magnetic materials that show large crystalline magnetic anisotropy, such as barium ferrite, and in which conditions of deposition can be controlled to get a proper texture.

Referring now to the drawing, an electron beam gun 1 is shown focused onto a crucible 3. This gun is used as the energy source to vaporize the rare earth and cobalt being fed therein in the form of continuous wires 5. The beam from the gun is directed and focused by a magnetic coil 7. A substrate in the form of endless belt 9 passes around rollers 11, 13 and 15. The rollers are positioned relative to the crucible 3 so that belt 9 is exposed to the vapors of the components which are being vaporized therein. Roller 11 is in the form of a drum. Means, such as heat exchange coil 17, are provided for circulating cooling fluid therethrough so as to control the temperature of the substrate 9 in first zone X above crucible 3 to within a preselected temperature range so that the vaporized components of the material solidify or deposit on the substrate as a crystalline material. Means for vibrating the belt, such as vibrating rollers 15, are positioned in a second zone Y spaced from the first zone so that the vapor deposited material will separate from the substrate and collect in collection box 19 positioned below zone Y. The vibrating rollers 15 are vibrated synchronously, for example by being connected to sonic horns or cams (not shown). The choice of actuating means for the rollers depends upon the frequency used to remove the material from the substrate 9. Damping rollers 13 are positioned outside vibrating rollers 15 to control vibration of rollers 15 so that the vibration of belt 9 is substantially confined to the area between rollers 15 in zone Y. Belt 9 may be formed of solid or imperforate material, but is preferably of a mesh material such as a molybdenum or tungsten alloy mesh or a mesh formed from a high temperature nickel alloy, the important factor being that the $RCo_5$ material deposited must not permanently bond to the substrate. Crucible 3, substrate belt 9, and collection box 19 are all positioned in a vacuum chamber 21. Preferably box 19 is provided with means for isolating it from the evacuated interior of chamber 21 so that access to and removal of the material may be accomplished and the apparatus thus operated in a semicontinuous fashion.

Although the above apparatus has been described in its operation of producing a powder material, this apparatus may also be used to produce a foil material according to the instant invention. In such a case a doctor knife or other suitable device is provided for separating the foil material from the substrate and no vibrating means is utilized. As has been discussed, the material desirably comprises an alloy of a rare earth and cobalt, preferably an intermetallic compound of cobalt and a rare earth, such as cerium, praseodymium, promethium, samarium and yttrium, the atomic ratio of cobalt to rare earth being about 5:1.

When the substrate belt 9 is maintained at a temperature between about 0.4 of the melting point and the melting point of the intermetallic compound, the material is deposited as a continuous film which can be removed as a foil. Depending upon the particular desired application, such foil may be loosely stacked or compressed into a bundle with or without the application of a bonding agent.

The material is then subjected to a magnetic field to form a high field strength bulk permanent magnet.

By maintaining substrate 9 at a temperature less than about 0.4 of the absolute melting temperature of the intermetallic compound, the material is deposited as loosely adhering particles which are removed as a flaky powder. The production of the flaky powder has been found to be particularly effective when the substrate is maintained at a temperature of about 0.35 of the absolute melting temperature of the intermetallic compound. When the flaky powder is collected in collection box 19, the flakes may be compacted together to produce a high field strength bulk permanent magnet material. If desired a suitable binder, such as an epoxy resin, is added during the compaction step.

It is to be understood that instead of a two wire feed 5, as shown in the drawing wherein the separate components of the alloy, e.g., the intermetallic compound, are vaporized, a body of the alloy in bulk form such as a single wire of the alloy, may also be utilized for introduction into the chamber 21 and vaporized to form the vaporized components.

In all cases a permanent magnet material having high magnetic anisotrophy and comprising oriented crystals having parallel basal planes and a close packed hexagonal grain structure will be produced. A much harder magnet is produced from these materials than from barium ferrite. The coercive force of a magnet formed of $RCo_5$ material is greater by a factor of 10 than the coercive force of a similar magnet formed of barium ferrite.

The following examples illustrate the invention:

For example, when cobalt and yttrium are fed into the crucible 3 in wire form as indicated at 5 and are vaporized by the electron beam gun 1 while the substrate 9, comprising a nickel wire mesh, is cooled by the drum 11 to a temperature on the order of 570°K. or less, the vaporized cobalt and yttrium are deposited on the substrate as $YCo_5$ intermetallic compound in the form of a solid, crystalline powder which is readily loosened from the substrate and collected in the box 19 by vibration of the substrate at the location of the rollers 15. Alternately, where the substrate 9 is maintained at a temperature on the order of 650°K. or higher by regulating the cooling effect of the drum 11 with respect to the heating effect of the vaporizing cobalt and yttrium materials, the $YCo_5$ intermetallic compound is deposited on the substrate 9 as a solid, crystalline foil material which is readily peeled from the substrate near the location of the rolls 15 to be taken up on an appropriate reel. These $YCo_5$ materials are of the $D2_5$ crystalline type having a melting point of 1625°K. The materials display a Curie point of 975°K. and a magnetic moment in Bohr magnetons of 8.2 at 1.4°K.

Alternately, where cobalt and cerium are fed into the crucible and are vaporized while the same substrate 9 is maintained at a temperature on the order of 515°K., a solid crystalline powder of $CeCo_5$ intermetallic compound is deposited on the substrate. These same vapor materials form a foil of the intermetallic compound on the substrate when the substrate temperature is maintained at a temperature on the order of 590°K. or higher. These $CeCo_5$ materials are also of the $D2_5$ crystalline type and have a melting point of 1478°K. These materials display a Curie point of 687°K. and a magnetic moment in Bohr magnetons of 7.4 at 1.4°K.

In another example illustrating this invention, where cobalt and gadolinium are vaporized in the crucible and are deposited on the substrate 9, $GdCo_5$ intermetallic compounds are formed on the substrate, the compounds being deposited in powder form at substrate temperatures on the order of 560°K. or less and in foil form at substrate temperatures on the order of 680°K. or higher. These $GdCo_5$ materials are of the $D2_5$ crystalline type and have a melting temperature of 1710°K. The materials display a Curie point of 1030°K. and a magnetic moment in Bohr magnetons of 1.3 at 1.4°K.

These materials display a high value of crystalline magnetic anisotropy having an easy direction of magnetization in the <00.1> direction. The close packed plane in the hexagonal crystal structure is in the <00.1> plane. When these materials are subjected to a strong magnetic field, a very useful permanent magnet material results.

In view of the above, it will be seen that the several objects of the invention are achieved and other advantageous results attained.

As various changes can be made in the above methods, constructions, and products without departing from the gist of the invention, it is intended that all matter contained in the above description or shown in the accompanying drawing shall be interpreted as illustrative.

What is claimed is:

1. The method of producing a magnetic material which is adapted to display a high magnetic anisotropy when subjected to a magnetic field for orienting the crystals thereof, said method comprising:

establishing a vapor phase of the components of a material characterized by high crystalline magnetic anisotropy, said material comprising an intermetallic compound of a rare earth and cobalt wherein the atomic ratio of cobalt to said rare earth is approximately 5:1;

passing the vaporized components into contact with a substrate maintained at a temperature such that the material will solidify and deposit thereon in the form of crystals with basal planes parallel to the plane of the substrate; and separating the vapor deposited material from the substrate;

said substrate being maintained at a temperature between about 0.4 of the melting point and the melting point of the material so that the material is deposited as loosely adhering particles and wherein said vapor deposited material is separated from said substrate as a flaky powder.

2. The method of claim 1 wherein the substrate is maintained at a temperature of about 0.35 of the melting point of the material.

3. The method of claim 1 wherein the substrate having the solidified, vapor deposited flaky powder thereon is vibrated so as to separate the powder from the substrate.

4. The method of claim 3 wherein the material is deposited on the substrate at a first zone and the powder is separated from the substrate at a second zone spaced from the first zone.

* * * * *